US009040796B2

(12) United States Patent
Yoshino

(10) Patent No.: US 9,040,796 B2
(45) Date of Patent: May 26, 2015

(54) DRUM

(71) Applicant: ROLAND CORPORATION, Shizuoka (JP)

(72) Inventor: Kiyoshi Yoshino, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 0 days.

(21) Appl. No.: 14/247,263

(22) Filed: Apr. 8, 2014

(65) Prior Publication Data

US 2014/0305280 A1 Oct. 16, 2014

(30) Foreign Application Priority Data

Apr. 15, 2013 (JP) ..... 2013-084682

(51) Int. Cl.
*G10D 13/02* (2006.01)

(52) U.S. Cl.
CPC ..... *G10D 13/023* (2013.01); *G10D 13/02* (2013.01)

(58) Field of Classification Search
CPC ..... G10D 13/023; G10D 13/02
See application file for complete search history.

(56) References Cited

U.S. PATENT DOCUMENTS

| | | | | |
|---|---|---|---|---|
| 2,485,985 | A | 10/1949 | Perry et al. | |
| 5,025,697 | A * | 6/1991 | May | 84/411 R |
| 5,375,500 | A * | 12/1994 | Halpin | 84/413 |
| 5,610,350 | A * | 3/1997 | Miller | 84/413 |
| 6,043,419 | A * | 3/2000 | Arbiter | 84/411 R |
| 6,265,650 | B1 * | 7/2001 | Arbiter | 84/411 R |
| 6,586,665 | B1 * | 7/2003 | Liao et al. | 84/411 R |
| 7,074,994 | B2 * | 7/2006 | Belli | 84/411 R |
| 7,442,867 | B1 | 10/2008 | Hunter | |
| 7,781,661 | B2 * | 8/2010 | Rogers et al. | 84/413 |
| 8,404,957 | B2 | 3/2013 | Richards | |
| 2014/0305280 | A1 * | 10/2014 | Yoshino | 84/411 A |

FOREIGN PATENT DOCUMENTS

| | | |
|---|---|---|
| DE | 95131 | 12/1897 |
| GB | 1558045 | 12/1979 |
| GB | 2302200 | 1/1997 |
| WO | 97/29479 | 8/1997 |

OTHER PUBLICATIONS

"Extended European Search Report of European counterpart application", issued on May 15, 2014, p. 1-p. 7.

* cited by examiner

*Primary Examiner* — Robert W Horn
(74) *Attorney, Agent, or Firm* — Jianq Chyun IP Office

(57) ABSTRACT

A drum includes a fixing means for fixing an edge portion of the membrane member; an interval forming means for forming an interval between the edge portion, fixed by the fixing means, and the striking surface of the membrane member in a normal direction of a plane of the striking surface; and contact members in contact with a connection portion of the membrane member, which connects the edge portion and the striking surface. The contact members contact the connection portion respectively at different positions along a circumferential direction of the connection portion. The contact members are in contact with an inner side of the tension ring and are displaced toward a center of the striking surface as the diameter of the circle surrounded by the tension ring is reduced.

20 Claims, 10 Drawing Sheets

DRUM

CROSS-REFERENCE TO RELATED APPLICATIONS

This application claims the priority benefit of Japan application serial no. 2013-084682, filed on Apr. 15, 2013. The entirety of the above-mentioned patent application is hereby incorporated by reference herein and made a part of this specification.

BACKGROUND OF THE INVENTION

1. Field of the Invention

The present invention relates to a drum. More particularly, the present invention relates to a drum that is capable of applying uniform tension to a membrane member constituting a striking surface.

2. Description of Related Art

A drum of this type is found in the following Patent Literature 1, for example. In the drum, a member (bead 18) having a U-shaped cross-section is connected with end portions of a membrane member (skin 17). Then, the U-shaped member is disposed on a drum shell side surface and a tension ring (clamp ring 22) is tightened, so as to push the U-shaped member below a striking surface. Here, including the tension ring, a mechanism that pushes the U-shaped member downward through a tightening of the tension ring is made of stainless steel or the like.

The inventors have established that, for the aforementioned drum, it is difficult to apply uniform tension to the membrane member that constitutes the striking surface.

PRIOR ART LITERATURE

Patent Literature

[Patent Literature 1] U.S. Pat. No. 6,043,419 (Specification)

SUMMARY OF THE INVENTION

In view of the above, the present invention is directed to achieving uniform tension in a drum in which tension is applied to the membrane member, constituting the striking surface, by reducing a diameter of a circle surrounded by a tension ring disposed along an outer circumference of the drum.

The drum of an embodiment of the present invention achieves the following effects. An interval forming means is used to form an interval between the striking surface and an edge portion of the membrane member in a normal direction of a plane of the striking surface. Moreover, contact members are disposed to be in contact with a connection portion that connects the striking surface and the edge portion. Then, when the diameter of the circle surrounded by the tension ring is reduced, the contact members are displaced toward a center of the striking surface. As the contact members are displaced toward the center of the striking surface, a length of the connection portion between the striking surface and the edge portion in a cross-section, which is parallel to the normal direction of the plane of the striking surface and passes through the center of the striking surface, increases. Therefore, tension is applied to the striking surface. Meanwhile, multiple contact members are used to respectively contact the connection portion at different positions along a circumferential direction of the connection portion. Accordingly, the tension applied to the striking surface is uniformized easily.

In addition to the aforementioned effects, the drum of another embodiment of the present invention further achieves the following effects. As the contact members are displaced toward the center side of the striking surface along with the reduction of the diameter of the circle surrounded by the tension ring, positions of portions of an inner side of the tension ring that are in contact with the respective contact members change. Thus, in order to smoothly displace the contact members toward the center side of the striking surface, it is preferable to smoothly displace the contact members along an inner circumferential direction of the tension ring. Regarding this, a sliding facilitation configuration is provided to facilitate the sliding of the contact members in the inner circumferential direction of the tension ring, such that the contact members can be smoothly displaced on the inner circumference of the tension ring. In other words, the contact members can be smoothly displaced toward the center side of the striking surface.

In addition to the aforementioned effects, the drum of another embodiment of the present invention further achieves the following effects. Each of the contact members is a fragment of a hollow disc-shaped member, and therefore, a contact portion between the contact member and the connection portion is arc-shaped. For this reason, the tension can be applied more uniformly. Further, multiple contact members are connected with each other respectively by a connection member. In comparison with the case where no connection member is provided for connecting the contact members, the present invention facilitates the assembly of the contact members. Moreover, deviation of the contact members in the circumferential direction can be suppressed to achieve uniform tension.

In addition to the aforementioned effects, the drum of another embodiment of the present invention further achieves the following effects. A clearance is formed among a front side fixing means, the contact members, and a back side fixing means for allowing the contact members to displace toward the center side of the striking surface. Thus, the contact members can be easily displaced toward the center side of the striking surface.

In addition to the aforementioned effects, the drum of another embodiment of the present invention further achieves the following effects. When an interval is formed between the striking surface and the edge portion of the membrane member in the normal direction of the plane of the striking surface, an interval is also formed between the striking surface and the edge portion in the direction parallel to the plane. Here, if the striking surface and the edge portion are not separated in the direction parallel to the plane, the connection portion has to be perpendicular to the striking surface, so as to form the interval between the striking surface and the edge portion of the membrane member in the normal direction of the plane of the striking surface. For this reason, the membrane member needs to be very flexible in order to apply uniform tension; otherwise, in order to achieve uniform tension, it is necessary to additionally perform a plastic deformation process on the membrane member. In contrast thereto, in the drum of this embodiment, the striking surface and the edge portion have the interval therebetween in the direction parallel to the plane. Therefore, the interval between the striking surface and the edge portion of the membrane member in the normal direction of the plane of the striking surface can be formed by a relatively simple method, such as forming a slack in the membrane member in advance.

In addition to the aforementioned effects, the drum of another embodiment of the present invention further achieves the following effects. The contact members are in contact with a frame member. Thus, in the normal direction of the plane of the striking surface, the contact members and the edge portion are spaced by a thickness of the frame member. Here, in the case when the contact members are rectangular instead of L-shaped at a cross-section face perpendicular to the striking surface, a ratio of the length of the connection portion in the cross-section face perpendicular to the striking surface with respect to a displacement amount when the contact members are displaced toward the center side of the striking surface is small as compared with the case of being L-shaped. Therefore, the contact members that are L-shaped at the cross-section face perpendicular to the striking surface can increase a ratio of the tension applied to the striking surface with respect to the displacement amount when the contact members are displaced toward the center side of the striking surface.

In addition to the aforementioned effects, the drum of another embodiment of the present invention further achieves the following effects. Because the contact members are fitted to a groove portion of the tension ring, displacement of the contact members in an unintended direction, such as the normal direction of the plane of the striking surface, can be restricted properly.

In addition to the aforementioned effects, the drum of another embodiment of the present invention further achieves the following effects. Because the back side fixing means is provided with a step portion, positioning of the membrane member on the fixing means becomes easy. Further, in the case when the step portion may come into contact with the frame member, the step portion can function as a supporter for suppressing the following situation, that is when the frame member is applied with a force toward the center side of the striking surface due to the tension applied to the membrane member, the frame member may be broken due to the force.

In addition to the aforementioned effects, the drum of another embodiment of the present invention further achieves the following effects. The membrane member is provided with a mesh. Compared to a film, etc., used on an acoustic drum, for example, the membrane member with the mesh is more flexible. Therefore, tension can be applied easily by the interval forming means.

DESCRIPTION OF THE EMBODIMENTS

First Embodiment

The first embodiment of a drum of the present invention is explained below with reference to the figures.

Figure 1:
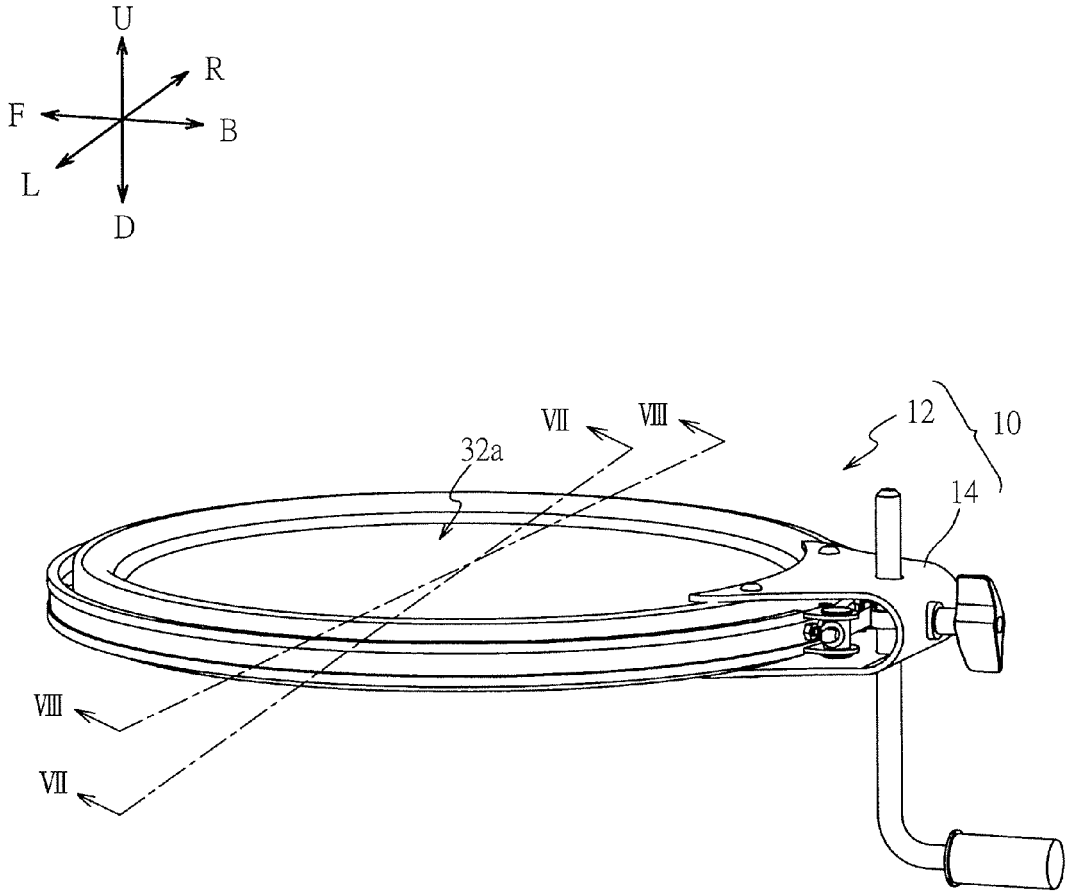
FIG. 1 is a schematic perspective view of a drum unit of the first exemplary embodiment.

FIG. 1 is a schematic perspective view of a drum unit 10. As illustrated in this figure, the drum unit 10 includes a drum 12 and a support member 14 that supports the drum 12. The drum 12 is an electronic drum configured to sense the striking of a stick, not shown in this figure, and generate a sound that simulates a striking sound of an acoustic drum corresponding to the striking. A sensor and an information processing device that constitute the electronic drum may be implemented utilizing the conventional technology and thus will be not described in detail hereinafter.

In FIG. 1, a normal direction of a plane formed by a striking surface 32*a* of the drum 12 is at a vertical upper side of the figure, and this direction is defined as an upward direction U and the opposite direction is defined as a downward direction D. Then, in the plane of the striking surface 32*a*, a front direction F and a back direction B opposite to the front direction F are respectively defined. Moreover, a pair of directions, orthogonal to the front direction F and the back direction B, is defined as a right direction R and a left direction L respectively.

Figure 2:
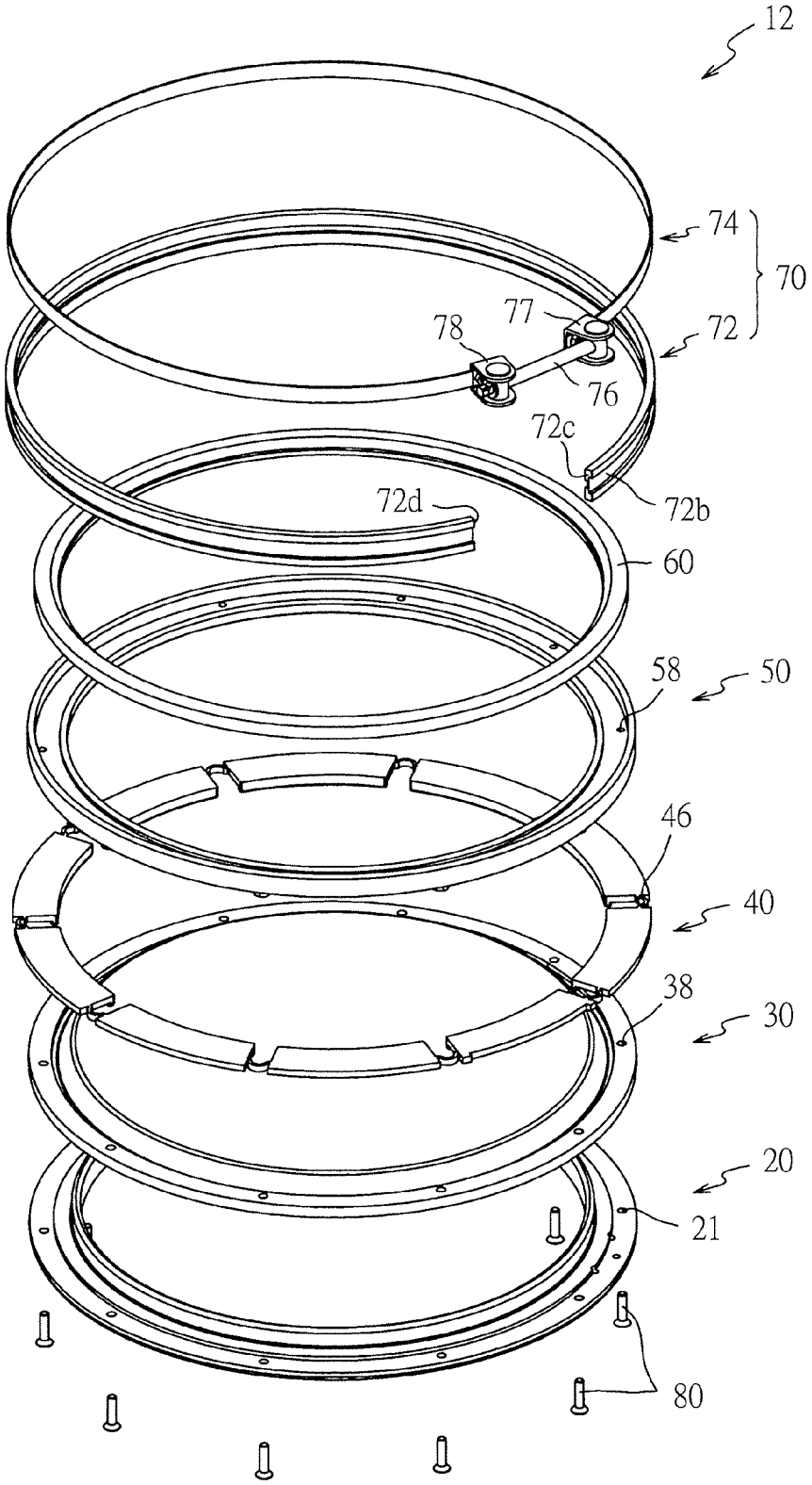
FIG. 2 is a schematic exploded view of a drum.

FIG. 2 is an exploded perspective view of the drum 12. As illustrated in the figure, the drum 12 includes a frame 20, a head 30, contact plates 40, a rim 50, a hoop rubber 60, and a tension ring 70. The contact plates 40 are connected together by connection members 46. The frame 20, head 30, contact plates 40, rim 50, and hoop rubber 60 are assembled by assembly screws 80. The tension ring 70 includes an inner ring 72 and an outer ring 74 and is disposed along an outer circumference of the drum 12.

Here, the inner ring 72 that constitutes the tension ring 70 is an open-loop ring member made of resin. More specifically, the inner ring 72 is formed using soft resin such as nylon, etc. The outer ring 74 that constitutes the tension ring 70 is made of stainless steel. The outer ring 74 is also an open-loop ring member, which has coupling members 77 and 78 at two end portions to be coupled with each other by a bolt 76. A distance between the coupling members 77 and 78 can be reduced by tightening the bolt 76. Thus, with the outer ring 74 fitted to an outer circumferential groove 72*b* of the inner ring 72, a distance between a pair of end portions 72*c* and 72*d* of the inner ring 72 can be shortened by tightening the bolt 76. That is, a diameter of a circle surrounded by the inner ring 72 is reduced, so as to apply tension to the head 30. A configuration for applying tension is described in detail hereinafter.

Figure 3B:
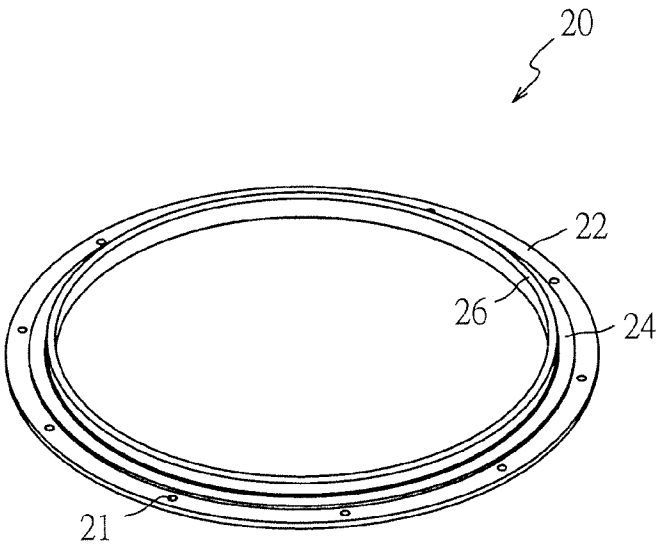
FIG. 3B is a schematic perspective view of the frame.
Figure 3A:
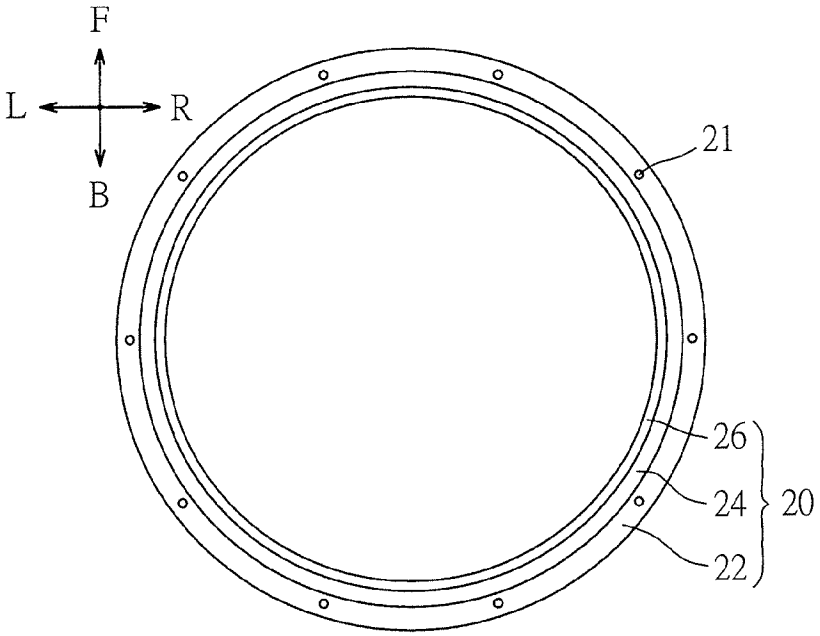
FIG. 3A is a schematic plane view of a frame.
Figure 3C:
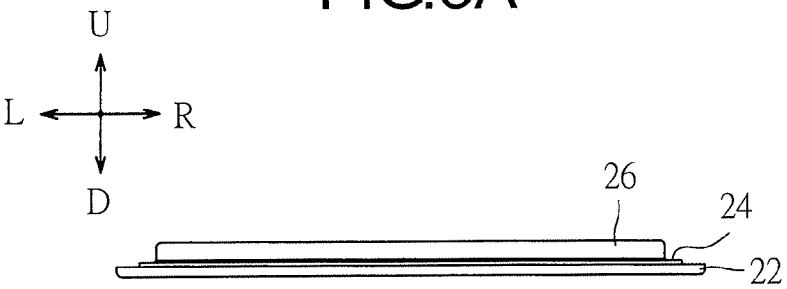
FIG. 3C is a schematic side view of the frame.

FIG. 3A is a schematic plane view of the frame 20. FIG. 3B is a schematic perspective view of the frame 20. FIG. 3C is a schematic side view of the frame 20.

As shown in the figure, the frame 20 has a frame base 22, a step portion 24, and a striking surface support portion 26. The frame base 22 is formed in a hollow disc shape. The step portion 24 is formed in a hollow disc shape and rises above the frame base 22. The striking surface support portion 26 is formed in a cylindrical shape which protrudes in the upward direction U above the step portion 24. The step portion 24 is provided on an inner side of the frame base 22. In addition, the striking surface support portion 26 is provided further on the inner side of the step portion 24.

The frame base 22 is provided with holes 21 for fitting the assembly screws 80 (see FIG. 2). In particular, in this exemplary embodiment, the holes 21 are arranged at equal intervals on an outer circumference of the frame base 22. More specifically, the holes 21 are disposed at ten positions at every 36°.

Besides, in this exemplary embodiment, the frame 20 is made of resin. To be more specific, the frame 20 is made of glass fiber reinforced resin.

Figure 4A:
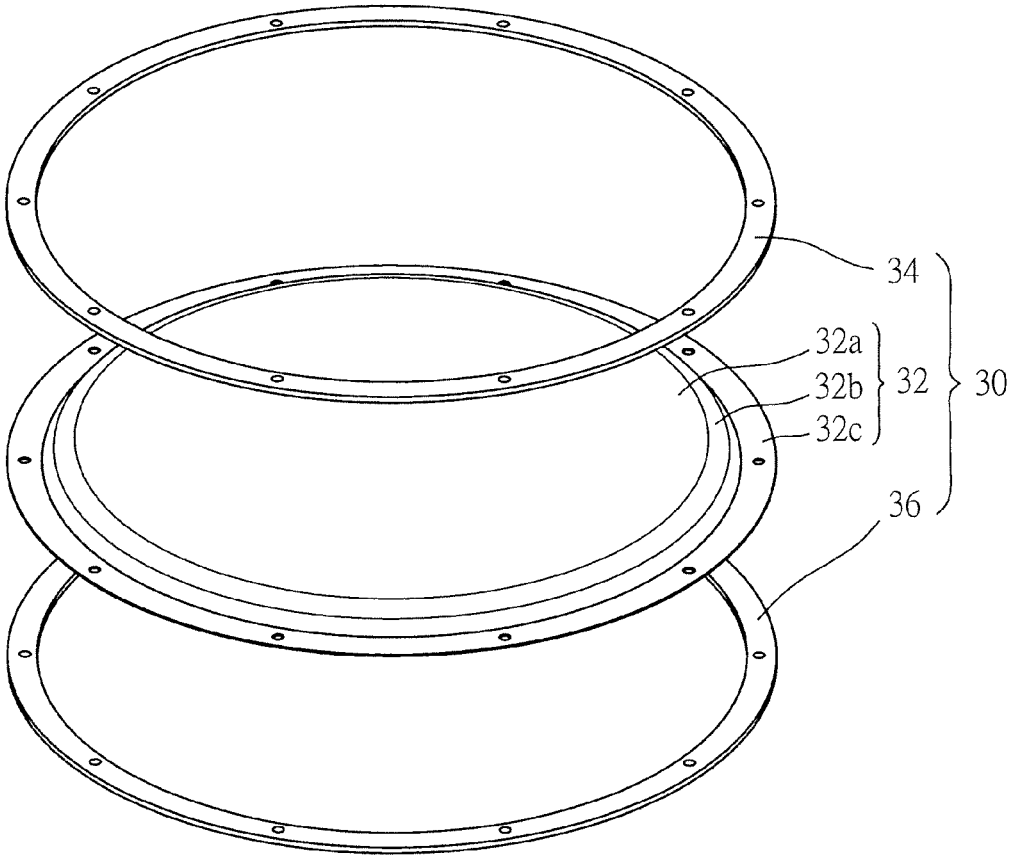
FIG. 4A is an exploded perspective view of a head.
Figure 4B:
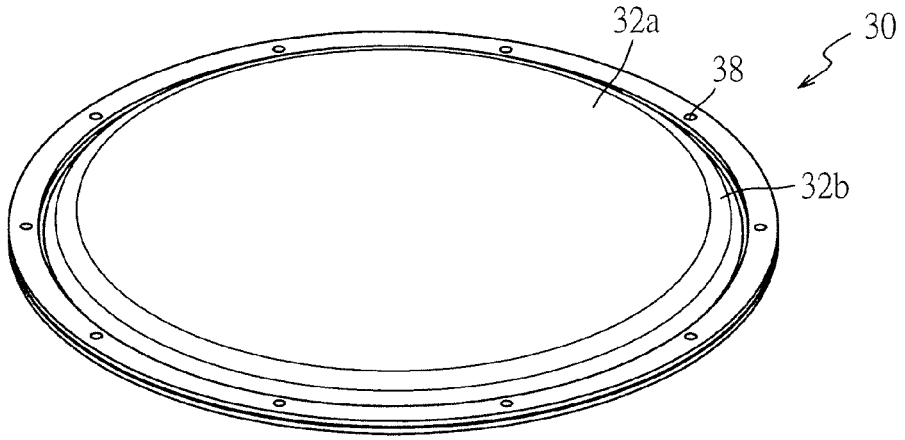
FIG. 4B is a schematic perspective view of the head.

FIG. 4A is an exploded perspective view of the head 30. FIG. 4B is a schematic perspective view of the head 30. The head 30 includes a membrane member 32, and an upper frame 34, and a lower frame 36. The membrane member 32 is a member having a mesh. The upper frame 34 and the lower frame 36 are members made of resin for sandwiching an edge (edge portion 32*c*) of the membrane member 32 on the upper and lower sides. The membrane member 32 is fixed to the upper frame 34 and the lower frame 36 by bonding or welding. The membrane member 32 used in this exemplary embodiment is formed by welding outer circumferential portions of two meshes without fraying the yarn and forming a plurality of holes in the welded portions. As shown in FIG. 4A, not only the membrane member 32, the upper frame 34 and the lower frame 36 are also formed with a plurality of holes. These holes are configured for fitting the assembly screws 80 (see FIG. 2). The respective holes of the membrane member 32, the upper frame 34, and the lower frame 36, as depicted in this figure, form the holes 38 of the head 30 in FIG. 4B, to which the assembly screws 80 are fitted.

The membrane member 32 is formed with a slack. The slack can be implemented for example by pulling the striking surface 32*a* away from the edge portion 32*c* in the normal direction of the striking surface 32*a* using a jig when the membrane member 32 is fixed to the upper frame 34 and the lower frame 36. Because of the slack, a connection portion 32*b* that connects the striking surface 32*a* and the edge portion 32*c* is formed between the striking surface 32*a* and the edge portion 32*c*. However, the connection portion 32*b* refers to a predetermined portion among parts of the head 30 that is formed in the formation of the drum 12 with the head 30 as shown in FIG. 1. That is to say, it is not possible to exactly define which part of the head 30 is the connection portion 32*b* when the head 30 is present alone. The exact definition of the connection portion 32*b* will be described later.

Figure 5B:
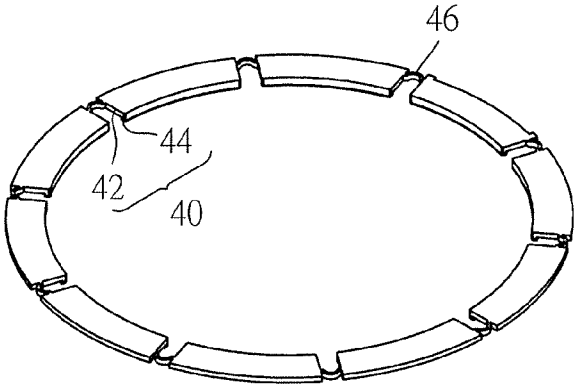
FIG. 5B is a schematic perspective view of the contact plate.
Figure 5A:
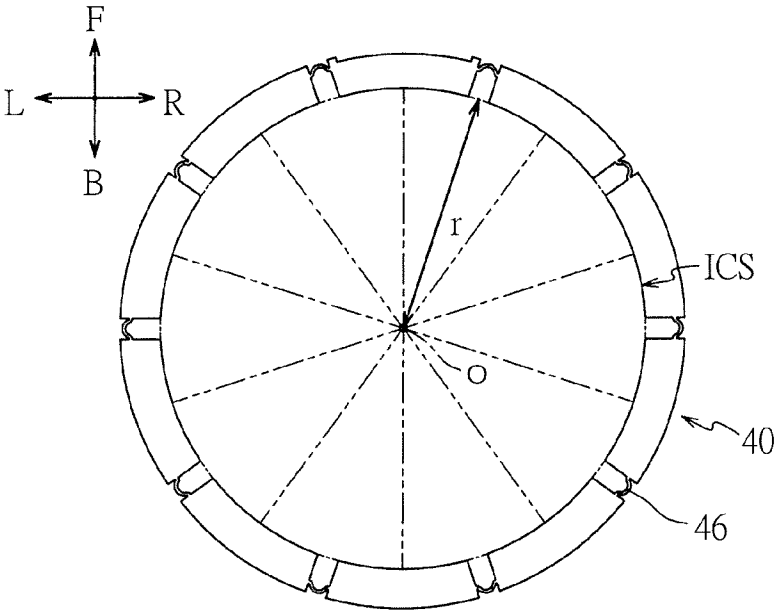
FIG. 5A is a schematic plane view of a contact plate.
Figure 5C:
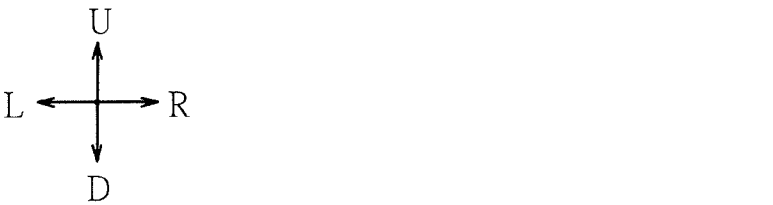
FIG. 5C is a schematic side view of the contact plate.

FIG. 5A is a schematic plane view of the contact plates 40. FIG. 5B is a schematic perspective view of the contact plates 40. FIG. 5C is a schematic side view of the contact plates 40.

As shown in the figures, in this exemplary embodiment, the contact plate 40 is a fragment of a hollow disc. The contact plate 40 is made of resin. In particular, in this exemplary embodiment, the contact plate 40 is made of plastic. According to this exemplary embodiment, the contact plates 40 have the same size and the same shape. Further, as shown in FIG. 5A, an inner circumferential surface ICS of the contact plate 40 has an arc shape with a radius r.

As illustrated in FIG. 5B and FIG. 5C, the contact plate 40 includes a base portion 42 and a protrusion portion 44. The protrusion portion 44 is a thick portion of the contact plate 40, which is formed at the side of the inner circumferential surface ICS of the contact plate 40. The base portion 42 is formed integrally with the protrusion portion 44 using the same material.

In this exemplary embodiment, ten contact plates 40 are provided. The contact plates 40 are connected with each other by connection members 46 of the same size and the same shape. Thus, the inner circumferential surfaces ICS of the contact plates 40 are arranged substantially uniformly along a circumferential direction of the striking surface 32*a*. That is, centers of the inner circumferential surfaces ICS of the contact plates 40 are respectively directed to ten directions divided at substantially equal angles, namely "360/10=36°", from a center O.

The connection member 46 is an arc-shaped member that is bent in an outward direction away from the center O.

Figure 6B:
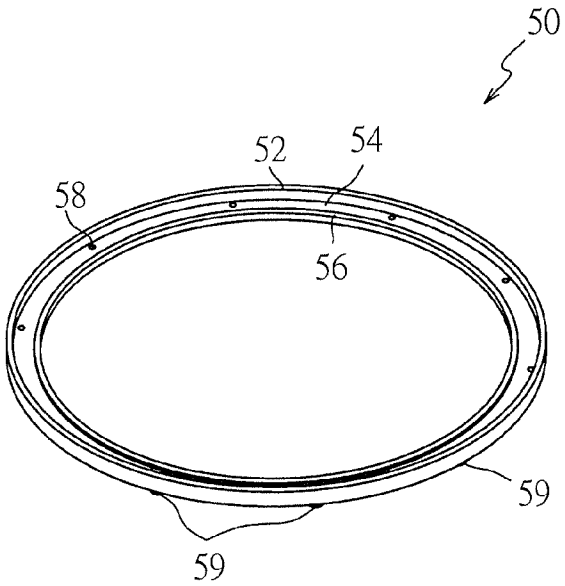
FIG. 6B is a schematic perspective view of the rim.
Figure 6A:
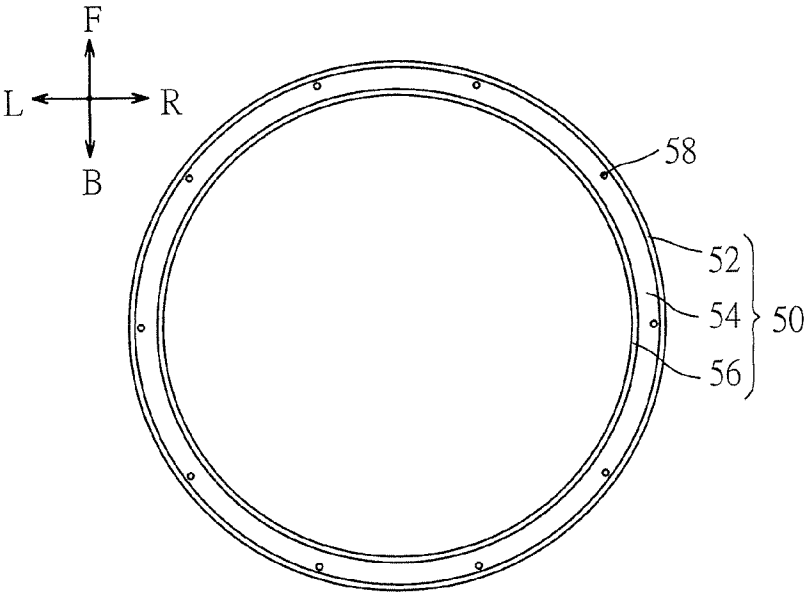
FIG. 6A is a schematic plane view of a rim.
Figure 6C:
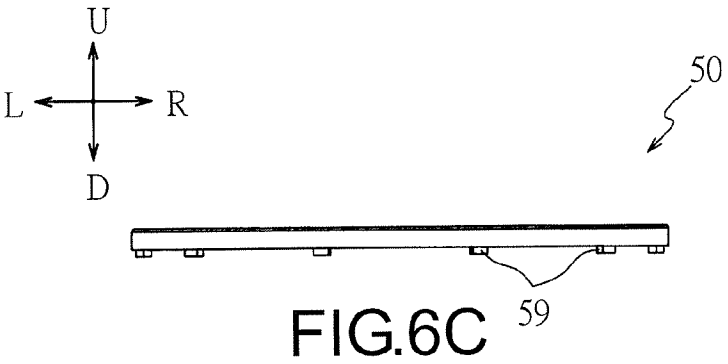
FIG. 6C is a schematic side view of the rim.

FIG. 6A is a schematic plane view of the rim 50. FIG. 6B is a schematic perspective view of the rim 50. FIG. 6C is a schematic side view of the rim 50.

The rim 50 includes a rim base 54, an outer circumferential side protrusion portion 52, and an inner circumferential side protrusion portion 56. The rim base 54 is formed in a hollow disc shape. The outer circumferential side protrusion portion 52 is formed in a cylindrical shape on an outer circumferential side of the rim base 54. The inner circumferential side protrusion portion 56 is formed in a cylindrical shape on an inner circumferential side of the rim base 54. An interval between the outer circumferential side protrusion portion 52 and the inner circumferential side protrusion portion 56 is set to a value for fitting the hoop rubber 60 (see FIG. 2). Moreover, a height of the inner circumferential side protrusion portion 56 is set lower than a height of the outer circumferential side protrusion portion 52. The reason is that, as shown in FIG. 1, since the striking surface 32*a* is on the inner side and lower than the inner circumferential side protrusion portion 56, interference between the inner circumferential side protrusion portion 56 and the stick is avoided. The hoop rubber 60 is a member for absorbing the impact when a rim shot is made. Here, the rim shot refers to striking the rim with the stick, which is not shown in the figure.

As shown in FIG. 6C, leg portions 59 are formed on a side of the rim base 54 without the inner circumferential side protrusion portion 56 and the outer circumferential side protrusion portion 52 (the side of the downward direction D). The leg portions 59 are disposed corresponding to the holes 58 that are for fitting the assembly screws 80 (see FIG. 2), as shown in FIG. 6A and FIG. 6B. The leg portion 59 is hollow and has a square pillar shape.

In this exemplary embodiment, the rim 50 is made of resin. More specifically, the rim 50 is composed of glass fiber reinforced resin.

Figure 7:
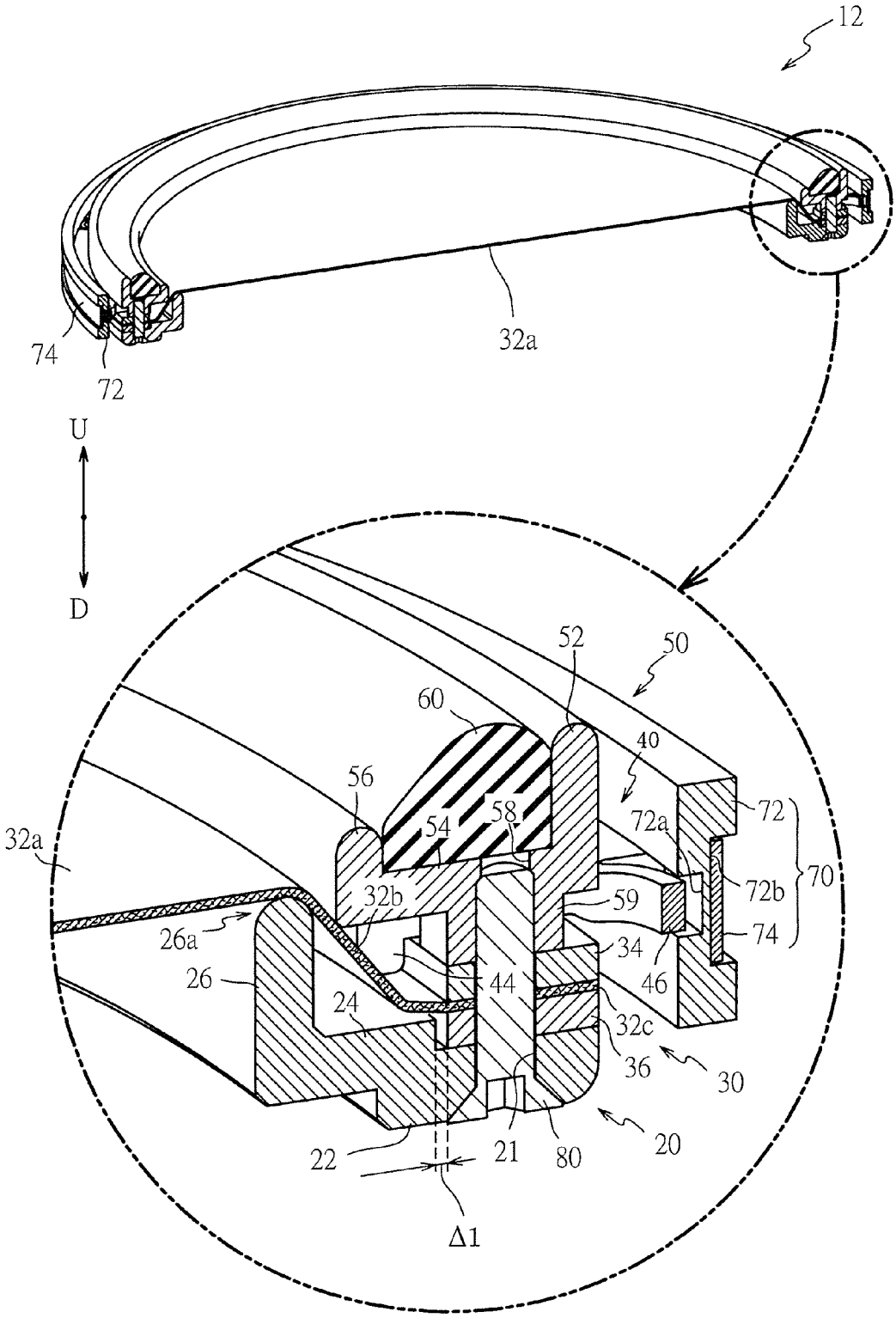
FIG. 7 is a schematic cross-sectional view of the drum along the line VII-VII.

FIG. 7 is a VII-VII cross-sectional view of FIG. 1. The VII-VII cross-sectional view depicts a cross-section that is parallel to the upward direction U and the downward direction D of FIG. 1 and along a plane passing through the center of the striking surface 32*a*.

As illustrated by the enlarged view of FIG. 7, the lower frame 36 of the head 30 is placed on the frame base 22, and the upper frame 34 of the head 30 is in contact with the leg portions 59 of the rim 50. Then, the frame 20, the head 30, and the rim 50 are secured by the assembly screws 80. By tightening the assembly screws 80, the leg portions 59 and the frame base 22 fasten the head 30 (the upper frame 34, the edge portion 32*c*, and the lower frame 36). The leg portions 59 are located between the contact plates 40 which are adjacent and closer to the center side of the striking surface 32*a* than the connection members 46.

Here, in the head 30, a portion that is in contact with the striking surface support portion 26 becomes a boundary between the striking surface 32*a* and the connection portion 32*b*. The connection portion 32*b* of the head 30 extends to the striking surface support portion 26 from the edge portion 32*c*. Here, in the normal direction of the plane of the striking surface 32*a* (the upward direction U), a front end portion 26*a* of the striking surface support portion 26 is located at the upper side of the edge portion 32*c*. This is because the striking surface support portion 26 extends upward with respect to the frame base 22 and the step portion 24. A length of the upward extension of the striking surface support portion 26 is set such that a length of the connection portion 32*b* is greater than a length of the inner circumferential surface ICS of the contact plate 40 (see FIG. 5) in the normal direction of the plane of the striking surface 32*a* (the upward direction U). This is to form an interval equal to or greater than the length of the inner circumferential surface ICS of the contact plate 40 in the normal direction between the striking surface 32*a* and the edge portion 32*c* in the normal direction of the plane of the striking surface 32*a* (the upward direction U).

In addition, the front end portion 26*a* of the striking surface support portion 26 has a rounded shape, so as not to cause damage to the membrane member 32. Further, in this exemplary embodiment, a diameter of the inner circumference of the lower frame 36 is set equal to or greater than a diameter of the outer circumference of the step portion 24, such that the lower frame 36 does not interfere with the step portion 24 when the lower frame 36 is placed on the frame base 22. Moreover, there is a clearance Δ1 between the step portion 24 and the lower frame 36, which is implemented by making the diameter of the inner circumference of the lower frame 36 slightly greater than the diameter of the outer circumference of the step portion 24. The aforementioned "making the diameter of the inner circumference of the lower frame 36 slightly greater than the diameter of the outer circumference of the step portion 24" excludes manufacturing tolerances. Regardless of tolerances, it is preferable to set the clearance Δ1 as small as possible but within a range that the actual diameter of the inner circumference of the lower frame 36 is not smaller than the actual diameter of the outer circumference of the step portion 24.

Figure 8:
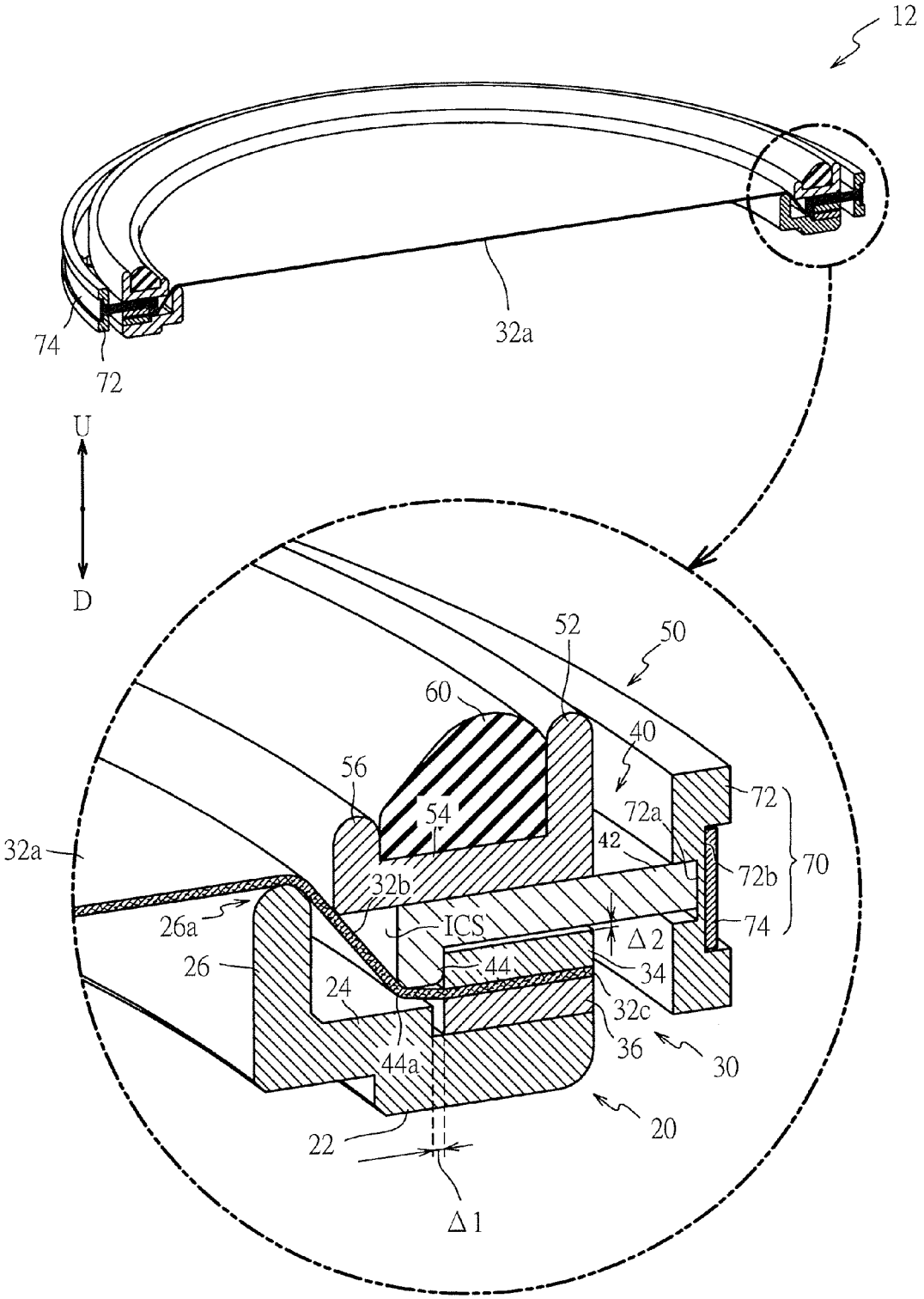
FIG. 8 is a schematic cross-sectional view of the drum along the line VIII-VIII.

FIG. 8 is a VIII-VIII cross-sectional view of FIG. 1. The VIII-VIII cross-sectional view depicts a cross-section that is parallel to the upward direction U and the downward direction D of FIG. 1 and along the plane passing through the center of the striking surface 32*a*. In particular, the VIII-VIII cross-sectional view depicts a cross-section of a portion excluding the assembly screws 80 shown in FIG. 2.

A cross-sectional shape of the connection portion 32*b* is bent rather than straight. This is because the protrusion portion 44 of the contact plate 40 is in contact with the connection portion 32*b*. A corner portion 44*a* of the protrusion portion 44 has a rounded shape.

A length of the leg portion 59 extending from the rim base 54, as shown in FIG. 7, is made greater than a thickness of the contact plate 40 to an extent of a clearance Δ2. Thus, the clearance Δ2 is formed between the contact plate 40 and the rim base 54 or the upper frame 34 of the head 30, such that the contact plate 40 is smoothly displaceable in a direction parallel to the plane of the striking surface 32*a*. A surface of the contact plate 40 opposite to the inner circumferential surface ICS is slidably fitted to an inner circumferential groove 72*a* of the inner ring 72.

Figure 9A:
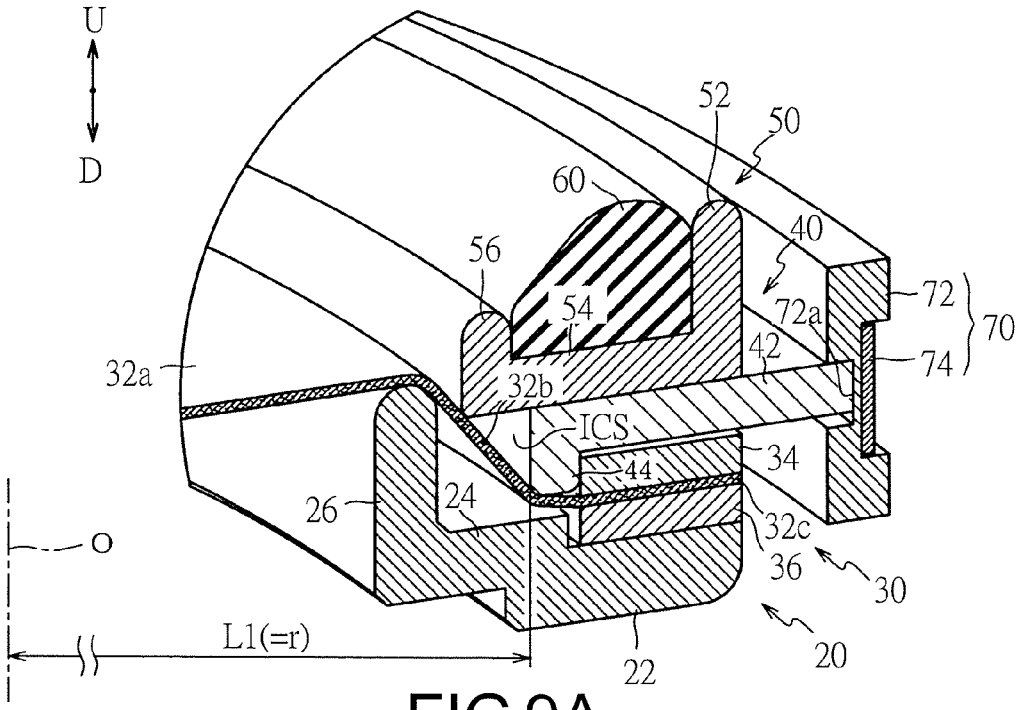
FIG. 9A is a schematic cross-sectional view showing a tension applying means of the drum.
Figure 9B:
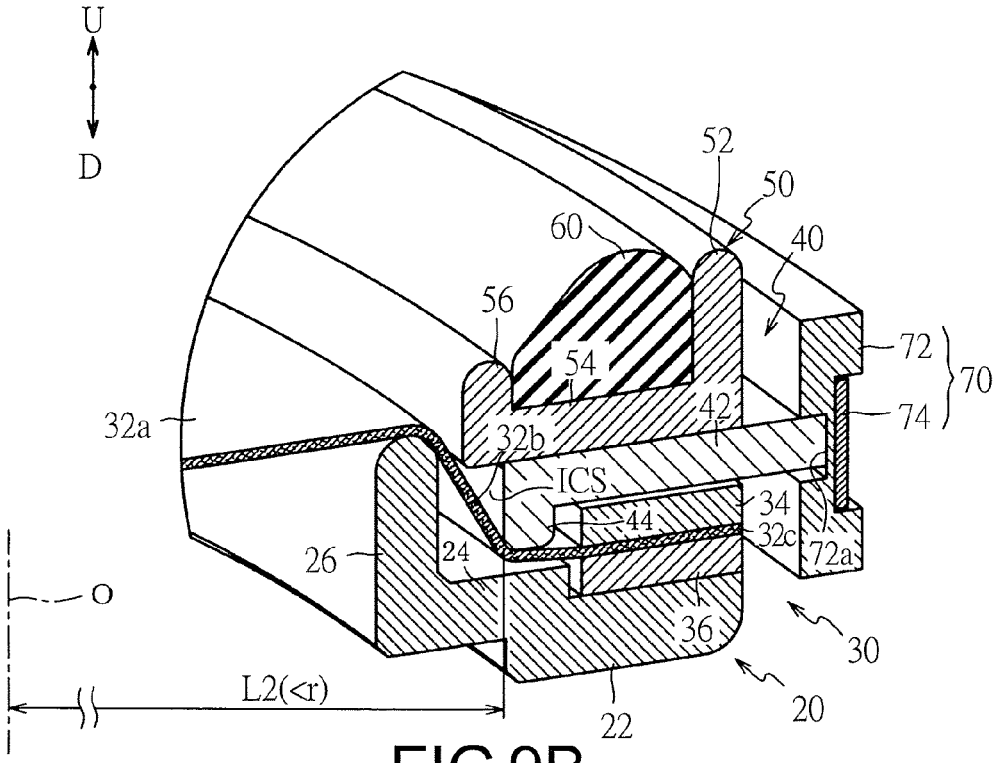
FIG. 9B is a schematic cross-sectional view showing the tension applying means of the drum.

Based on the above configuration, tension can be applied to the striking surface 32*a* by tightening the tension ring 70. FIG. 9A and FIG. 9B are VIII-VIII cross-sectional views of FIG. 1.

As shown in FIG. 9A, before the tension ring 70 is tightened, the protrusion portion 44 of the contact plate 40 is in contact with the upper frame 34, and the inner circumferential surface ICS of the contact plate 40 is at a position farthest from the center of the striking surface 32*a*. Because of the contact plate 40, in this state, the length of the connection portion 32*b* in the cross-section (the cross-section shown in FIG. 9A) perpendicular to the plane of the striking surface 32*a* is longer due to the influence of the protrusion portion 44, as compared to the case where there is no contact plate 40. Thus, tension is applied to the striking surface 32*a*. Before that, however, the connection portion 32*b* and the edge portion 32*c* are pulled to the side of the striking surface 32*a* by the striking surface support portion 26, and the striking surface 32*a* is pulled to the side of the connection portion 32*b*. Therefore, tension of a certain degree is given to the striking surface 32*a*.

On the other hand, as shown in FIG. 9B, when the tension ring 70 is tightened, the inner circumferential groove 72*a* of the tension ring 70 is displaced toward the center side of the striking surface 32*a*. As a result, the contact plate 40 is also displaced toward the center side of the striking surface 32*a*. Therefore, in comparison with the state before the tension ring 70 is tightened (FIG. 9A), the length of the connection portion 32*b* in the cross-section perpendicular to the plane of the striking surface 32*a* and passing the center of the striking surface 32*a* (the cross-section shown in FIG. 9B) becomes longer. In other words, tension of the striking surface 32*a* is increased.

In this exemplary embodiment, the radius r of an arc drawn by the inner circumferential surface ICS (see FIG. 5) is equal to a distance L1 before the tension ring 70 is tightened (FIG. 9A). Here, the distance L1 refers to the distance between the inner circumferential surface ICS and the center O of the striking surface 32*a* in the direction parallel to the plane of the striking surface 32*a* before the tension ring 70 is tightened (FIG. 9A). This is to make the inner circumferential surface ICS contact the connection portion 32*b* as uniformly as possible in an initial position prior to tightening the tension ring 70. When the contact plate 40 is disposed at the position farthest from the center of the striking surface 32*a*, a contact portion of the connection portion 32*b* and the contact plate 40 draws a circle with the distance L1 as the radius. Therefore, by equalizing the radius r of the arc drawn by the inner circumferential surface ICS and the distance L1, it is possible to uniform the tension applied to the connection portion 32*b* when the inner circumferential surface ICS is in contact with the connection portion 32*b*. Moreover, by tightening the tension ring 70 (FIG. 9B), a distance L2 becomes smaller than the radius r of the arc drawn by the inner circumferential surface ICS (see FIG. 5). Here, the distance L2 refers to the distance between the inner circumferential surface ICS and the center O of the striking surface 32*a* in the direction parallel to the plane of the striking surface 32*a* when the tension ring 70 is tightened (FIG. 9B). Therefore, the tension that two end portions of the inner circumferential surface ICS apply to the connection portion 32*b* with respect to the tension that a central portion of the inner circumferential surface ICS applies to the connection portion 32*b* tends to decrease gradually. Specifically, the contacting force at the connection portion 32*b* and a center portion of the inner circumferential surface ICS becomes stronger as the distance L2 becomes smaller than the radius r. The contacting force at the connection portion 32*b* and two ends of the inner circumferential surface ICS becomes stronger or weaker depending on situations. However, the latter contacting force is relatively weaker than the former contacting force as the distance L2 becomes smaller than the radius r.

The exemplary embodiment described above achieves the following effects.

(1) As shown in FIGS. 9A and 9B, etc., there is an interval between the striking surface 32*a* and the edge portion 32*c* of the membrane member 32 in the normal direction of the plane of the striking surface 32*a* (the upward direction U, etc.), and the inner circumferential surface ICS of the contact plate 40 is disposed to be in contact with the connection portion 32*b* which connects the striking surface 32*a* and the edge portion 32. Further, the distance between two end portions of the tension ring 70 (the distance between the end portions 72*c* and 72*d* of the inner ring 72 as shown in FIG. 2) is reduced so as to displace the contact plate 40 toward the center of the striking surface 32*a*. Thus, tension can be applied to the striking surface 32*a* by tightening the tension ring 70. In particular, since the tension can be applied by displacing the contact plate 40 toward the center of the striking surface 32*a*, the distance between the striking surface 32*a* and the rim 50 or the hoop rubber 60 is not changed by the applied tension. In addition, as compared with the case where the edge portion 32*c* is pulled in the downward direction (the downward direction D) of the striking surface 32*a*, the thickness of the drum 12 can be easily reduced.

(2) Multiple contact plates 40 are disposed to contact the connection portion 32*b* respectively at different positions in the circumferential direction of the connection portion 32*b*. Thus, the tension applied to the striking surface 32*a* is uniform.

(3) The portion of the contact plate 40 that is in contact with the connection portion 32*b* is formed in an arc shape (see FIG. 5). Therefore, the tension applied to the striking surface 32*a* is uniform.

(4) The contact plate 40, as shown in FIG. 8, etc., is made of plastic and the inner ring 72 is made of soft resin. Consequently, the contact plate 40 can easily slide in the inner circumferential groove 72*a*. Here, as the tension ring 70 is tightened, a position of the contact portion of the contact plate 40 and the inner circumferential groove 72*a* changes. With the aforementioned configuration (sliding facilitation configuration) that makes the contact plate 40 easily slidable in the inner circumferential groove 72*a*, the contact plate 40 can be smoothly displaced toward the center side of the striking surface 32*a*. Further, because of the aforementioned configuration that makes the contact plate 40 easily slidable in the inner circumferential groove 72*a*, the contact plates 40 can be prevented from deviation in the circumferential direction, so as to apply the tension uniformly.

(5) As illustrated in FIG. 8, the leg portion 59 (FIG. 7) is designed in a way that the interval between the upper frame 34 of the head 30 and the rim base 54 is greater than the thickness of the base portion 42 of the contact plate 40. Therefore, the contact plate 40 can be slid easily on a lower surface of the rim base 54. As a result, even when the tension ring 70 is tightened, the contact plate 40 can still be easily displaced toward the center side of the striking surface 32*a*.

(6) As shown in FIG. 8, etc., the frame 20 is provided with the step portion 24, and the striking surface support portion 26 is formed on the inner circumferential side thereof. Accordingly, in the direction parallel to the plane of the striking surface 32*a*, there is an interval between the striking surface support portion 26 and the portion of the frame base 22 on which the edge portion 32*c* of the membrane member 32 is placed. Moreover, when an interval is formed between the striking surface 32*a* and the edge portion 32*c* of the membrane member 32 in the normal direction of the plane of the striking surface 32*a* (the upward direction U), an interval is further formed between the striking surface 32*a* and the edge portion 32*c* in the direction parallel to the plane. Here, in the situation that there is the interval between the striking surface 32*a* and the edge portion 32*c* of the membrane member 32 in the normal direction of the plane of the striking surface 32*a*, the connection portion 32*b* will be perpendicular to the striking surface 32*a* if the striking surface 32*a* and the edge portion 32*c* are not separated in the direction parallel to the plane. For this reason, if the membrane member 32 is not very flexible, uniform tension cannot be achieved; otherwise, in order to apply uniform tension, it is necessary to additionally perform a plastic deformation process on the membrane member 32. In contrast thereto, in this exemplary embodiment, the striking surface 32*a* and the edge portion 32*c* have the interval therebetween in the direction parallel to the plane. Therefore, the interval between the striking surface 32*a* and the edge portion 32*c* of the membrane member 32 in the normal direction of the plane of the striking surface 32*a* can be formed by a relatively simple method, such as forming the slack in the membrane member 32 in advance.

(7) As shown in FIG. 8, etc., an interval forming means for forming the interval between the striking surface 32*a* and the edge portion 32*c* of the membrane member 32 in the normal direction of the plane of the striking surface 32*a* (the upward direction U) is implemented by the striking surface support portion 26 that has the cylindrical shape (see FIG. 3). Because the striking surface support portion 26 is in contact with the entire circumference of the striking surface 32*a*, it is possible to appropriately suppress the problem of applying non-uniform tension to the striking surface 32*a*.

(8) As shown in FIG. 8, etc., the contact plate 40 is formed with the base portion 42 and the protrusion portion 44. By doing so, the contact plate 40 is L-shaped at the cross-section face perpendicular to the plane of the striking surface 32*a* and passing through the center of the striking surface 32*a*, and the connection portion 32*b* is in contact with a short portion of the L-shaped portion (the protrusion portion 44). Thus, as compared with the case where the contact plate 40 is formed solely with the base portion 42, the length of the connection portion 32*b* in the cross-section (cross-section shown in FIG. 8, etc.) perpendicular to the plane of the striking surface 32*a* can be lengthened in the exemplary embodiment of the present invention. Therefore, a ratio of the tension applied to the striking surface 32*a* with respect to a displacement amount when the contact plate 40 is displaced toward the center side of the striking surface 32*a* can be increased.

(9) As shown in FIG. 8, etc., a groove portion (the inner circumferential groove 72*a*) is formed in the tension ring 70 for fitting the contact plate 40. Thus, displacement of the contact plate 40 in an unintended direction, such as the normal direction of the plane of the striking surface 32*a* (the upward direction U, etc.), can be restricted properly.

(10) The inner ring 72 as shown in FIG. 8, etc., is formed of soft resin, so as to facilitate applying uniform tension to the contact plate 40. In contrast thereto, if the inner ring 72 is made of metal, the inner ring 72 has very high rigidity, and the inventors found that, due to the high rigidity of the inner ring 72, the outer circumferential shape (approximate circle) of the region enclosed by the tension ring 70 when the tension ring 70 is tightened may greatly deviate from a mathematically exact circle easily, which very likely causes non-uniform tension.

(11) The tension ring 70 as shown in FIG. 2, etc. is formed with the inner ring 72, made of resin, and a thin plate member (the outer ring 74), made of metal. Here, in the case where the entire tension ring 70 is made of resin, the tension ring 70 may not be able to withstand a force that is generated by shortening the distance between two ends of the open loop. On the other hand, in the case where the entire tension ring 70 is made of metal, it is difficult to apply uniform tension for the reason, stated above, resulting from the overly high rigidity. Considering these points, the tension ring 70 is formed with the inner ring 72, made of resin, and the outer ring 74, made of metal; and the ring made of resin is used as the member to be in contact with the contact plate 40 while the ring made of metal is used to tighten the contact plate 40. Accordingly, the tension ring 70 can withstand the tightening, and the tension applied to the contact plate 40 can be made uniform as much as possible.

(12) As shown in FIG. 7, etc., the frame 20 is provided with the step portion 24, which facilitates positioning when placing the head 30 on the frame 20. Further, by reducing the clearance Δ1 shown in FIG. 7, when the striking surface 32*a* is applied with tension, and the edge portion 32*c* or the lower frame 36 is pulled toward the center side of the striking surface 32*a*, the step portion 24 can function as a supporter for suppressing the force from breaking the lower frame 36.

(13) As shown in FIG. 5, etc., multiple contact plates 40 are connected with one another by the connection members 46. In comparison with the case where the contact plates 40 are not connected by the connection members 46, the assembly of the contact plates 40 in the exemplary embodiment of the present invention is easy. Moreover, deviation of arrangement of the contact plates 40 in the circumferential direction of the connection portion 32*b* can also be suppressed.

(14) As shown in FIG. 5, etc., the contact plates 40 have the same size and the same shape. Because of the symmetry, it is easy to apply uniform tension to the head 30.

(15) As shown in FIG. 9A, the radius r of the arc drawn by the inner circumferential surface ICS of the contact plate 40 (see FIG. 5) is made equal to the distance L1 between the inner circumferential surface ICS and the center O of the striking surface 32*a* in the direction parallel to the plane of the striking surface 32*a* before the tension ring 70 is tightened. As a result, it is possible to make the central portion of the inner circumferential surface ICS contact the connection portion 32*b* first. Therefore, a situation that only the two end portions of the inner circumferential surface ICS of the contact plate 40 apply tension to the connection portion 32*b* can be avoided.

(16) As shown in FIG. 5, etc., the connection member 46 is a member (a member protruding toward the outer side) which is bent outward toward a center side between a pair of contact plates 40 that are adjacent to each other. Here, when the contact plates 40 are displaced toward the center side of the striking surface 32*a*, the interval between the adjacent contact plates 40 is narrowed. Furthermore, the interval between the adjacent contact plates 40 is narrower on the side of the inner circumferential surface ICS than the side of the outer circumferential surface. Since the connection member 46 protrudes toward the outer side, when the contact plates 40 are displaced toward the center side of the striking surface 32*a*, the connection member 46 is less likely to interfere with the displacement.

(17) As shown in FIG. 5A, etc., the connection member 46 has the arc shape. Therefore, when the contact plates 40 are displaced toward the center side of the striking surface 32*a* and narrow the interval between adjacent contact plates 40, the width of the connection member 46 can be shortened easily. Consequently, when the contact plates 40 are displaced toward the center side of the striking surface 32*a*, it is possible to properly suppress the connection member 46 from interfering with the displacement.

(18) As shown in FIG. 8, the corner portion 44*a* of the protrusion portion 44 of the contact plate 40 has the rounded shape, so as to prevent the corner portion 44*a* from causing damage to the membrane member 32.

(19) As shown in FIG. 7, the front end portion 26*a* of the striking surface support portion 26 has the rounded shape, so as to prevent the front end portion 26*a* from causing damage to the membrane member 32.

(20) The membrane member 32 is provided with the mesh. Compared to a film, for example, the membrane member having the mesh is highly flexible, which makes it easy to form the interval between the striking surface 32*a* and the edge portion 32*c* in the normal direction of the plane of the striking surface 32*a*.

(21) As shown in FIG. 8, etc., the contact plates 40 are disposed closer to a front side of the striking surface 32*a* than the head 30. As compared with the case where the contact plates 40 are arranged closer to a back side of the striking surface 32*a* than the head 30, in the exemplary embodiment of the present invention, the distance between the striking surface 32*a* and the rim 50 or the hoop rubber 60 in the normal direction of the plane of the striking surface 32*a* (the upward direction U) can be reduced easily.

(22) The rim 50 is provided with the outer circumferential side protrusion portion 52 and the inner circumferential side protrusion portion 56. Thus, the rigidity of the rim 50 is increased to withstand the tension applied thereto which results from the tension applied to the membrane member 32.

(23) With the hoop rubber 60, even when a rim shot is made, the impact on the rim 50 or the contact plate 40, the edge portion of the head 30, and the frame 20, etc. can be lowered.

Second Embodiment

Hereinafter, the second embodiment is described with reference to the figures, focusing on the difference between the first and the second embodiments.

This embodiment is the same as the first embodiment, except that this embodiment includes a tension ring 90 in place of the tension ring 70.

Figure 10:
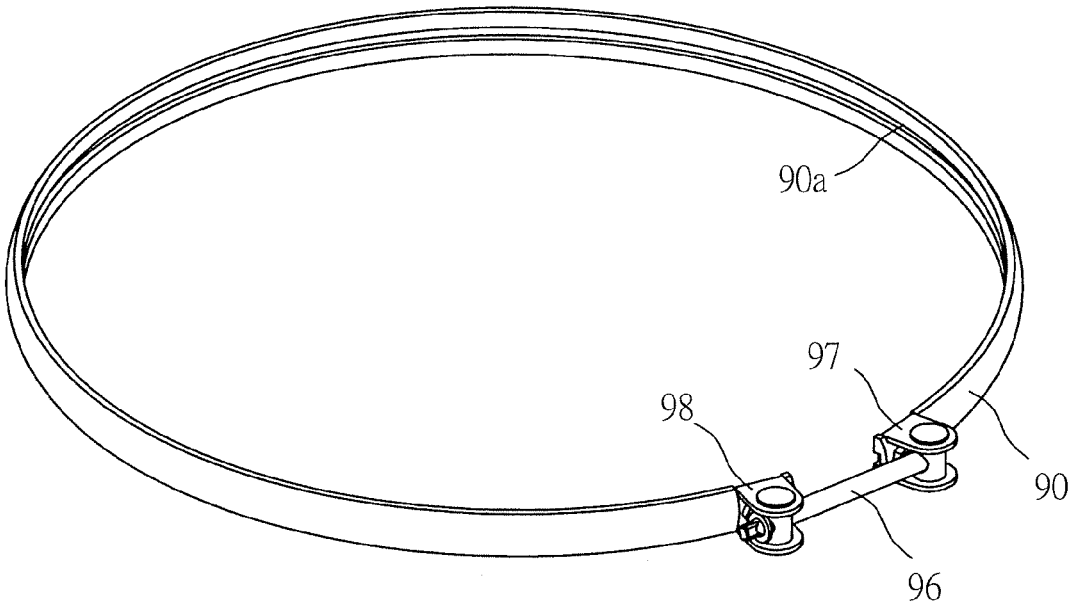
FIG. 10 is a schematic perspective view of a tension ring of the second embodiment.

FIG. 10 illustrates a structure of the tension ring 90 of this embodiment. As shown in the figure, the tension ring 90 of this embodiment is an open-loop ring member made of aluminum. At two end portions of the tension ring 90, coupling members 97 and 98, which respectively correspond to the coupling members 77 and 78 of FIG. 2, are disposed. The coupling members 97 and 98 are coupled by a bolt 96. Then, by tightening the bolt 96, a distance between the coupling members 97 and 98 can be reduced. An inner circumferential groove 90*a* is formed on an inner circumference of the tension ring 90 for fitting the contact plates 40 (see FIG. 2).

Other Embodiments

The above illustrates the present invention on the basis of the exemplary embodiments. However, it should be understood that the present invention is not limited to any of the above exemplary embodiments, and various modifications or alterations may be made without departing from the spirit of the present invention. The respective embodiment may also be modified by adding a part or some parts of the configuration of other embodiments to the respective embodiment, or replacing a part or some parts of the configuration of the respective embodiment with those of other embodiments. Embodiments of modifications of the above exemplary embodiments will be described hereinafter.

[Regarding Tension Ring] In the first embodiment (see FIG. 2), nylon is used as the soft resin for forming the inner ring 72. However, the soft resin is not limited to nylon. Additionally, in the first embodiment, a stainless steel plate is used as the outer ring 74. However, the metal ring is not limited thereto, and the metal ring may be aluminum or the like, for example.

In the second embodiment (see FIG. 10), the tension ring 90 is made of aluminum. However, the material of the tension ring 90 is not limited thereto. For example, the tension ring 90 may be made of stainless steel.

In addition, the tension ring is not necessarily configured in the manner that the diameter of the circle surrounded by the tension ring is reduced by shortening the distance between the two end portions of the open loop. For example, the tension ring may be formed in an arc shape that exceeds 360° with regions of the pair of end portions of the tension ring overlapping each other in the circumference of the approximately circular shape formed by the tension ring. In that case, the diameter of the circle surrounded by the tension ring is reduced as the overlap increases. In the above situation, it is preferable that the tension ring does not have a step on the inner circumferential surface thereof by using the end portion on the inner circumferential side among the pair of end portions of the tension ring. In other words, it is preferable to make the shape of the outer circumference of the region enclosed by the tension ring approximate to a mathematically exact circle as much as possible.

[Regarding Method for Securing Gap between Front Side Fixing Means and Back Side Fixing Means] In the above exemplary embodiments, a front side fixing means is formed by the leg portions 59 that are disposed between adjacent contact plates 40 (see FIG. 7), and a back side fixing means is formed by the frame base 22. However, the present invention is not limited thereto. For example, the front side fixing means may be formed by the rim base 54, and the back side fixing means may be formed by a protrusion portion that is disposed on the upper frame 34 to protrude between the adjacent contact plates 40 and to be in contact with the front side fixing means. In the above configuration, the height of the protrusion portion may be designed to make the gap between the front side fixing means and the back side fixing means greater than the thickness of the contact plate 40, so as to form the clearance Δ2 (see FIG. 8).

Nevertheless, it is not necessary to form the clearance Δ2. The front side fixing means and the back side fixing means may also be configured to firmly sandwich the contact plates 40 without the clearance Δ2. In that case, the assembly screws 80 need to be loosened before tightening or loosening the tension ring 70.

[Regarding Back Side Fixing Means] In the above exemplary embodiments, the frame base 22 (the back side fixing means) and the striking surface support portion 26 (the interval forming means) are formed integrally with each other (see FIG. 7). However, the present invention is not limited thereto. For example, the frame base 22 and the striking surface support portion 26 may be &tined separately to be assembled by screws, etc.

Moreover, the back side fixing means is not necessarily disposed on the frame 20. Details thereof are specified in the section "Regarding Method for Securing Gap between Front Side Fixing Means and Back Side Fixing Means".

[Regarding Front Side Fixing Means] In the above exemplary embodiments, the front side fixing means is formed by the leg portions 59 shown in FIG. 7. However, the present invention is not limited thereto. The front side fixing means may be the rim base 54. Details thereof are specified in the section "Regarding Method for Securing Gap between Front Side Fixing Means and Back Side Fixing Means".

[Regarding Clearance between Step Portion and Head] In the above exemplary embodiments, regardless of the manufacturing tolerances, the clearance Δ1 between the lower frame 36 of the head 30 and the step portion 24 (see FIG. 7) is set as small as possible but within a range that the inner diameter of the lower frame 36 is not smaller than the outer diameter of the step portion 24. Here, the clearance Δ1 can be set to a value small enough to achieve contact between the lower frame 36 and the step portion 24 by applying tension to the striking surface 32*a*. However, the present invention is not limited thereto. For example, as long as the head 30 is not damaged, the clearance Δ1 may be a value that the lower frame 36 and the step portion 24 do not contact each other even when tension is applied to the striking surface 32*a*. In such a case, the formation of the step portion 24 still has the function of assisting the alignment of positions of the head 30 and the frame 20.

[Regarding Fixing Means] The step portion disposed on the frame 20 of the fixing means is not limited to the hollow disc-shaped step portion 24 (see FIG. 3). For example, the step portion may include a plurality of protrusion portions on the circumference. However, it is noted that the step portion is not necessary.

[Regarding Connection Member] The connection member that connects the contact plates 40 is not necessarily an arc-shaped member as shown in FIG. 5. For example, the connection member may have a shape formed by two sides of equal length of an isosceles triangle.

In addition, the connection member is not limited to the member that is bent outward. For example, the connection member may be a member bent inward. Further, the connection member may be an extendable arc-shaped member. For achieving the above more easily, it is preferable to form the arc-shaped member and the contact plates 40 with different materials.

It is also possible not to dispose the connection member for connecting the contact plates 40. In that case, however, it is preferable to dispose a restricting means for restricting the movement of the respective contact plate 40 in the circumferential direction, so as to prevent non-uniform arrangement of the contact plates 40 as much as possible. The restricting means may be formed by the assembly screws 80. However, it is preferable to dispose ribs that are stripe-shaped and face the center direction of the striking surface on the surface of the upper frame 34 of the head 30, for example, as the restricting means. Even in the above situation, it is preferable to arrange the contact plates 40 uniformly. Nevertheless, it is noted that the contact plates 40 are not necessarily arranged uniformly. For example, the inner ring 72 applies no force to the contact plates 40 between the end portions 72*c* and 72*d* of the inner ring 72. A contact density refers to a contact area per unit length of the inner ring 72 along the inner circumference or refers to a tension between the inner circumferential surface ICS and the connection portion 32*b*. By decreasing the gap between the adjacent contact plates 40 as a position of the inner ring 72 gets close to the end portions 72*c* and 72*d*, the contact density of the inner circumferential surface ICS of the contact plate 40 and the connection portion 32*b* may be increased.

[Regarding Contact Member] (a) Setting of Diameter of Inner Circumference: In the above exemplary embodiments, as shown in FIG. 9A, the contact plate 40 is in contact with the connection portion 32*b* at the initial position where the tension generated by the tension ring 70 is minimized. However, the present invention is not limited thereto. For example, the tension ring 70 may be tightened to displace the contact plate 40 toward the center side of the striking surface 32*a*, so as to cause the contact plate 40 to first come into contact with the connection portion 32*b*.

In each of the exemplary embodiments described above, the radius r of the arc drawn by the inner circumferential surface ICS of the contact plate 40 is set equal to the distance L1. However, the present invention is not limited thereto. Here, the distance L1 refers to the distance between the inner circumferential surface ICS and the center O of the striking surface 32*a* in the direction parallel to the striking surface 32*a* at the initial position where the tension of the tension ring 70 is minimized. For example, the radius r may also be set to a distance L3 (not shown in the figure). The distance L3 refers to the distance between the inner circumferential surface ICS of the contact plate 40 and the center O of the striking surface 32*a* in the direction parallel to the striking surface 32*a* when the contact plate 40 is displaced most toward the center side of the striking surface 32*a*. It is considered that, if the radius r is set smaller than the distance L1 and equal to or greater than the distance L3, the inner circumferential surface ICS applies the most uniform force to the connection portion 32*b* as the contact plate 40 is gradually displaced toward the center side of the striking surface 32*a*.

However, if the radius r is smaller than the distance L1, the force that the two end portions of the inner circumferential surface ICS of the contact plate 40 apply to the connection portion 32*b* may become greater than the force that the central portion of the inner circumferential surface ICS applies to the connection portion 32*b* at the time when the contact plate 40 first comes into contact with the connection portion 32*b*. In order to avoid this situation, the radius r may be slightly greater than the distance L1 (which is greater than "1" time of the distance L1 and less than "1.1" time of the distance L1, for example). Thus, regardless of the individual differences of the contact plates 40, the force that the central portion of the inner circumferential surface ICS applies to the connection portion 32*b* becomes greater than the force that the two end portions of the inner circumferential surface ICS apply to the connection portion 32*b* at the time when the contact plate 40 first comes into contact with the connection portion 32*b*. Nevertheless, the time when the contact plate 40 first comes into contact with the connection portion 32*b* may also be the initial position of the contact plate 40.

Furthermore, the radius r may be set smaller than the distance L1, and the two end portions of the inner circumference of the contact plate 40 may be rounded, such that, at the time when the contact plate 40 first comes into contact with the connection portion 32*b*, the portion of the inner circumferential surface ICS, which applies the greatest tension to the connection portion 32*b*, (the two end portions of the inner circumferential surface ICS) has a rounded shape.

(b) Number and Arrangement: The number of the contact plates is not limited to 10. However, the number of the contact plates is preferably four or more, and more preferably 8 or more. In addition, the inner circumferences of all of the contact plates 40 do not necessarily have the same size. In other words, the inner circumferences of the contact plates 40 may be formed in two sizes (arc lengths) or more. However, in order to apply uniform tension to the striking surface 32*a*, it is preferable that the inner circumferential surfaces ICS of the contact plates 40 are respectively directed to directions divided at substantially equal angles in the plane parallel to the plane of the striking surface 32*a*.

Moreover, the radius r of the arc drawn by the inner circumferential surface ICS of the contact plate 40 may or may not be the same for all the contact plates 40. For example, there may be two radii, and the contact plates 40 with the smaller radius may be disposed at the positions closest to the end portions 72*c* and 72*d* as shown in FIG. 2. Thus, for the contact plate 40 to which least force is exerted on the end portion of the contact plate 40 on the side opposite to the inner circumferential surface ICS, the radius of the arc drawn by the inner circumferential surface ICS is reduced intentionally to increase the force applied to the connection portion 32*b*.

Nevertheless, the contact plates 40 may be arranged non-uniformly. Details thereof are specified in the section "Regarding Connection Member".

(c) Shape: In the above exemplary embodiments, the corner portion 44*a* (FIG. 8) of the protrusion portion 44 (see FIG. 8) on the side facing the center of the striking surface 32*a* is rounded. However, the present invention is not limited thereto.

In each of the exemplary embodiments described above, the contact plate 40 is L-shaped at the cross-section face perpendicular to the striking surface 32*a* (see FIG. 8). However, the present invention is not limited thereto. The contact plate 40 may be a flat member. In other words, the protrusion portion 44 may not be necessary. Even in such a situation, it is preferable that the portion of the contact plate 40 that is in contact with the connection portion 32*b* is rounded, the same as the shape illustrated in FIG. 8.

The shape of the contact member is not limited to a fragment of a hollow circular disc. As long as the side that contacts the mesh has an arc shape, the tension applied to the connection portion 32*b* can be uniformized easily. Nevertheless, the inner circumferential surface ICS does not necessarily draw the arc for uniformizing the tension applied to the connection portion 32*b*. For example, the inner circumferential surface ICS may draw a polygonal line approximating the arc. Furthermore, the side of the contact member that is in contact with the mesh may have a straight shape. In that case, the tension applied to the connection portion 32*b* can still be uniformized by shortening the length of the contact portion between each contact member and the mesh in the circumferential direction of the striking surface 32*a*, and arranging the contact members uniformly along the circumferential direction of the connection portion 32*b*.

The contact portion of the inner circumferential surface ICS and the connection portion 32*b* can also be enlarged by reducing the radius of the arc drawn by the inner circumferential surface ICS as it gets closer to the upper side of the normal direction of the plane of the striking surface 32*a*.

(d) Others: The material of the contact plate 40 is not limited to resin. The contact plate 40 may also be made of metal or wood, for example.

For example, the surface of the rim base 54 that faces the contact plate 40 may tilt, and the surface of the upper frame 34 that faces the contact plate 40 may tilt as well, such that the inner circumferential surface ICS is displaced in the downward direction D of FIG. 8 as the contact plate 40 is displaced toward the center side of the striking surface 32*a*. In that case, depending on the tilt angle, it is possible to make the entire inner circumferential surface ICS contact the connection portion 32*b*.

[Regarding Sliding Facilitation Configuration] Regarding the sliding facilitation configuration, the materials of the contact plate 40 and the inner ring 72 are not limited to resin. For example, the portion of the contact plate 40 that is in contact with the inner circumferential groove 72*a*, and the surface of the inner circumferential groove 72*a* may both be formed of resin. Furthermore, at least one of the aforementioned portions that contact each other may be coated with lubricating oil or wax, or be adhered with a sliding tape. By doing so, the contact plate 40 can easily slide in the circumferential direction of the inner circumferential groove 72*a* regardless of the materials of the contact plate 40 and the inner ring 72.

[Regarding Method for Facilitating Displacement of Contact Member] The method for facilitating the displacement of the contact member is not limited to the aforementioned method of setting the clearance Δ2 or the sliding facilitation configuration. For example, in FIG. 8, at least one of the surfaces of the base portion 42 and the rim base 54 that are in contact with each other may be coated with a lubricant. It is noted that, in FIG. 8, due to the tension from the connection portion 32*b*, the base portion 42 of the contact plate 40 comes in contact with the rim base 54 against the gravity. Of course, at least one of the surfaces of the base portion 42 and the upper frame 34 that are opposed to each other may also be coated with a lubricant. Such a configuration is particularly effective, for example, when the rim 50 and the upper frame 34 are made of metal, which makes it difficult for the base portion 42 to slide on the rim base 54 or the upper frame 34. As described in the above exemplary embodiments, forming the contact plate 40, the frame 20, and the rim 50 using resin facilitates the displacement of the contact member.

[Regarding Positional Relationship between Head and Contact Member] In the above exemplary embodiments, the contact member (the contact plate 40) is disposed on the upper side (the side where the stick is held and swung down towards the striking surface 32*a*) of the edge of the head 30 (the edge portion 32*c*, the upper frame 34, and the lower frame 36) (see FIG. 8). However, the present invention is not limited thereto, and the configuration may be reversed. In that case, the interval forming means (the striking surface support portion 26) is removed from the frame 20 and is disposed on the rim 50, and the leg portions 59 are removed from the rim 50 and disposed on the frame 20, so as to dispose the edge portion 32*c* above the striking surface 32*a*.

[Regarding Interval Forming Means] In the above exemplary embodiments, the interval forming means is formed by the cylindrical striking surface support portion 26 as shown in FIG. 3. In this way, the contact portion of the membrane member 32 and the striking surface support portion 26 draws a circle in the direction parallel to the striking surface 32*a*. However, the present invention is not limited thereto. For example, the interval forming means may also have a plurality of protrusions that are arranged in a circular shape and spaced from each other.

In the above exemplary embodiments, the interval forming means, as shown in FIG. 7, is formed by the striking surface support portion 26, and the portion of the striking surface support portion 26 that is in contact with the connection portion 32*b* is rounded. However, the present invention is not limited thereto. For example, the VII-VII cross-section of the front end portion 26*a* of the striking surface support portion 26 may have a triangular shape or a rectangular shape.

In the above exemplary embodiments, the radius of the connection portion 32*b* of the membrane member 32 decreases as closer to the striking surface 32*a* in the normal direction of the striking surface 32*a* (the upward direction U) (see FIG. 8). However, the present invention is not limited thereto. For example, in the initial position, the connection portion 32*b* may be parallel to the normal direction. In that case, the connection portion 32*b* is displaced toward the inner side of the striking surface 32*a* in the plane parallel to the striking surface 32*a* as the contact plate 40 is displaced toward the center of the striking surface 32*a*.

The interval forming means is not limited to a member connected to the side of the frame 20. Details thereof are specified in the section "Regarding Positional Relationship between Head and Contact Member".

[Regarding Frame Member] The material of the frame member connected to the end portion of the mesh is not limited to resin. For example, the frame member may be made of metal.

[Regarding Membrane Member] The membrane member is not limited to the mesh. The membrane member may be a plastic film for an acoustic drum or the like, for example.

[Others] In the above exemplary embodiments, the frame 20 is made of resin. However, the present invention is not limited thereto. The material of the frame 20 may be aluminum or zinc, or even steel, for example. Here, in the case of using aluminum or zinc, it is preferable to form the frame by die casting. However, the present invention is not limited to using die casting. The frame may also be formed by cutting aluminum, for example. In the case of using steel, it is preferable to use stamping.

In the above exemplary embodiments, the rim 50 is made of resin. However, the present invention is not limited thereto. The material of the rim 50 may be aluminum or zinc, or even steel, for example. Here, in the case of using aluminum or zinc, it is preferable to form the rim by die casting. However, the present invention is not limited to using die casting. The rim may also be formed by cutting aluminum, for example. In the case of using steel, it is preferable to use stamping.

The drum is not limited to an electronic drum. The drum may be a practice drum using a mesh. In addition, the drum may be an acoustic drum that uses a plastic film, etc.

What is claimed is:

1. A drum adapted to apply tension to a membrane member, used for forming a striking surface, by reducing a diameter of a circle surrounded by a tension ring that is disposed along an outer circumference of the drum, the drum comprising:

a fixing means fixing an edge portion of the membrane member;

an interval forming means forming an interval between the edge portion, fixed by the fixing means, and the striking surface of the membrane member in a normal direction of a plane of the striking surface; and a plurality of contact members in contact with a connection portion of the membrane member, which connects the edge portion and the striking surface, wherein the plurality of contact members is disposed to contact the connection portion respectively at different positions along a circumferential direction of the connection portion, and the plurality of contact members are in contact with an inner side of the tension ring and are displaced toward a center of the striking surface as the diameter of the circle surrounded by the tension ring is reduced.

2. The drum according to claim 1, wherein at least one of a portion of the plurality of contact members that is in contact with the tension ring and a portion of the tension ring that is in contact with the plurality of contact members is provided with a sliding facilitation configuration for facilitating sliding of the plurality of contact members in an inner circumferential direction of the tension ring.

3. The drum according to claim 1, wherein each of the plurality of contact members is a fragment of a hollow disc-shaped member, and the drum further comprises a connection member provided for connecting adjacent contact members among the plurality of contact members.

4. The drum according to claim 2, wherein each of the plurality of contact members is a fragment of a hollow disc-shaped member, and a connection member is provided for connecting adjacent contact members among the plurality of contact members.

5. The drum according to claim 1, wherein the fixing means comprises a front side fixing means and a back side fixing means that sandwich the plurality of contact members from two sides of the plurality of contact members in the normal direction of the plane of the striking surface, and a clearance is formed among the front side fixing means, the plurality of contact members, and the back side fixing means for allowing the plurality of contact members to displace toward a center side of the striking surface.

6. The drum according to claim 2, wherein the fixing means comprises a front side fixing means and a back side fixing means that sandwich the plurality of contact members from two sides of the plurality of contact members in the normal direction of the plane of the striking surface, and a clearance is formed among the front side fixing means, the plurality of contact members, and the back side fixing means for allowing the plurality of contact members to displace toward a center side of the striking surface.

7. The drum according to claim 1, wherein, the shorter a distance between the connection portion and the striking surface in the normal direction of the plane is, the shorter a distance between the connection portion and the center side of the striking surface in a direction parallel to the plane becomes, thereby reducing the distance between the connection portion and the center of the striking surface.

8. The drum according to claim 2, wherein, the shorter a distance between the connection portion and the striking surface in the normal direction of the plane is, the shorter a distance between the connection portion and the center side of the striking surface in a direction parallel to the plane becomes, thereby reducing the distance between the connection portion and the center of the striking surface.

9. The drum according to claim 1, wherein the edge portion of the membrane member is connected with a frame member, and the plurality of contact members are in contact with the frame member, and the contact members are L-shaped at a cross-section face perpendicular to the striking surface and passing through the center of the striking surface, and a short portion of the L-shaped portion is in contact with the connection portion.

10. The drum according to claim 2, wherein the edge portion of the membrane member is connected with a frame member, and the plurality of contact members are in contact with the frame member, and the contact members are L-shaped at a cross-section face perpendicular to the striking surface and passing through the center of the striking surface, and a short portion of the L-shaped portion is in contact with the connection portion.

11. The drum according to claim 1, wherein the tension ring comprises a groove portion on the inner side, and the plurality of contact members are fitted in the groove portion.

12. The drum according to claim 2, wherein the tension ring comprises a groove portion on the inner side, and the plurality of contact members are fitted in the groove portion.

13. The drum according to claim 1, wherein the edge portion of the membrane member is connected with a frame member, and the fixing means comprises a step portion for restricting displacement of the frame member toward the center side of the striking surface.

14. The drum according to claim 2, wherein the edge portion of the membrane member is connected with a frame member, and the fixing means comprises a step portion for restricting displacement of the frame member toward the center side of the striking surface.

15. The drum according to claim 1, wherein the membrane member comprises a mesh.

16. A drum, comprising:

a tension ring;

a frame comprising a frame base, a step portion, and a striking surface support portion;

a head comprising a membrane member, and an upper frame and a lower frame sandwiching the membrane member; and a plurality of contact members, wherein the membrane member comprises a striking surface and an edge portion, and a connection portion is formed between the striking surface and the edge portion for connecting the striking surface with the edge portion, the edge portion of the membrane member is sandwiched by the upper frame and the lower frame, and the lower frame is placed on the frame base, the step portion is connected with the frame base, and the striking surface support portion is connected with the step portion, an interval is formed between the striking surface and the edge portion in a normal direction of the striking surface by the striking surface support portion, inner circumferential surfaces of the plurality of contact members are in contact with the connection portion, and the plurality of contact members contact the connection portion respectively at different positions along a circumferential direction of the connection portion, and the plurality of contact members are applied with a force toward a center side of the striking surface due to the tension ring.

17. The drum according to claim 16, wherein at least one of a portion of the plurality of contact members that is in contact with the tension ring and a portion of the tension ring that is in contact with the plurality of contact members is provided with a sliding facilitation configuration for facilitating sliding of the plurality of contact members in an inner circumferential direction of the tension ring.

18. The drum according to claim 16, wherein each of the plurality of contact members is a fragment of a hollow disc-shaped member, and the drum further comprises a connection member provided for connecting adjacent contact members among the plurality of contact members.

19. The drum according to claim 16, wherein the plurality of contact members are in contact with a frame member, and the contact members are L-shaped at a cross-section face perpendicular to the striking surface and passing through the center of the striking surface, and a short portion of the L-shaped portion is in contact with the connection portion.

20. The drum according to claim 16, wherein the tension ring comprises a groove portion on an inner side, and the plurality of contact members are fitted in the groove portion.

* * * * *